US006647897B1

(12) United States Patent
Klamka et al.

(10) Patent No.: US 6,647,897 B1
(45) Date of Patent: Nov. 18, 2003

(54) RAILWAY VEHICLE WITH SELF-SUPPORTING CAR BODY

(75) Inventors: Heinz Klamka, Hennigsdorf (DE); Jan Prockat, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 09/889,902

(22) PCT Filed: Jan. 19, 2000

(86) PCT No.: PCT/EP00/00374

§ 371 (c)(1),
(2), (4) Date: Oct. 15, 2001

(87) PCT Pub. No.: WO00/44601

PCT Pub. Date: Aug. 3, 2000

(30) Foreign Application Priority Data

Jan. 28, 1999 (DE) ..... 199 03 281

(51) Int. Cl.[7] ..... B61D 17/00
(52) U.S. Cl. ..... 105/397
(58) Field of Search ..... 105/396, 397, 105/399, 401, 238.1, 329.1

(56) References Cited

U.S. PATENT DOCUMENTS

| | | | | | |
|---|---|---|---|---|---|
| 5,388,529 | A | * | 2/1995 | Tieberghien et al. | 105/397 |
| 5,669,999 | A | * | 9/1997 | Anderegg et al. | 105/396 |
| 5,749,302 | A | * | 5/1998 | Tegeler | 105/397 |
| 5,918,548 | A | * | 7/1999 | Elsner et al. | 105/397 |

FOREIGN PATENT DOCUMENTS

| | | |
|---|---|---|
| DD | 83 378 | 7/1971 |
| DE | 32 22 887 A1 | 12/1983 |
| DE | 38 38 686 C2 | 5/1990 |
| DE | 195 12 629 A1 | 10/1996 |
| DE | 297 09 847 U1 | 8/1997 |
| EP | 0 405 889 A2 | 1/1991 |
| EP | 0 474 510 A1 | 3/1992 |
| EP | 0 544 473 A1 | 6/1993 |
| EP | 0 697 319 A1 | 2/1996 |
| EP | 0 786 390 A1 | 7/1997 |
| WO | WO 99/24302 | 5/1999 |

* cited by examiner

*Primary Examiner*—S. Joseph Morano
*Assistant Examiner*—Robert J. McCarry, Jr.
(74) *Attorney, Agent, or Firm*—Howrey Simon Arnold & White

(57) ABSTRACT

The invention relates to a railway vehicle with a self-supporting car body having a floor and a roof as well as side walls which present windows and access areas. The side walls are each made of a frame which is rigidly connected to the floor and presents side wall elements. The car body skin elements are configured in a supporting manner and fixed to frame elements (2) by friction so as to form a ribbed plate support structure (1, 8). The car body skin elements comprise an integrated intermediate layer (5) having vibration-damping properties. Frictional adhesive joints (7) or frictional screw or rivet joints (9) between the frame elements (2) and supporting car body skin elements can be provided for. The supporting car body skin elements are configured as supporting sandwich elements (3) which consist of an outer layer (4), an inner layer (6) and an intermediate layer (5) which has heat- and/or sound-insulating and vibration-damping properties and maintains the outer and inner layer at a distance from each other.

31 Claims, 1 Drawing Sheet

RAILWAY VEHICLE WITH SELF-SUPPORTING CAR BODY

Figure 1:
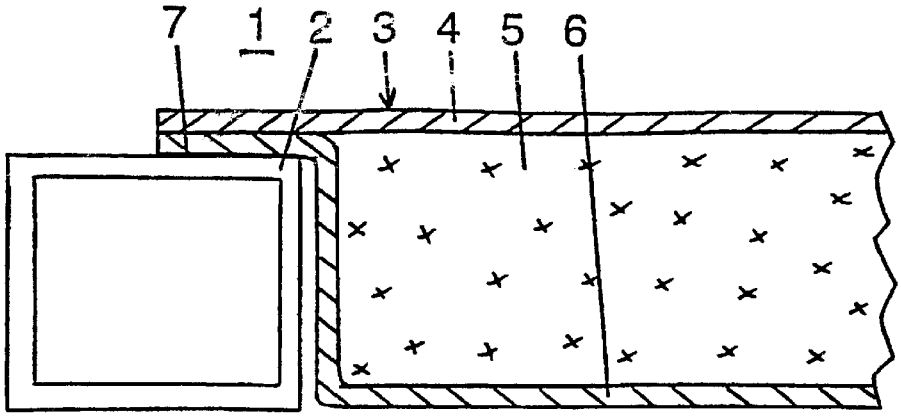

The invention relates to a rail vehicle with a self-supporting car body with a floor and a roof and with side walls, which have windows and entry zones, the structural car-body elements situated above the floor being formed by a frame that is connected in a flexurally rigid manner to the floor and has side wall or roof elements or the like mounted on it, the car-body skin elements being of load-bearing design and, to form a ribbed plate-type supporting structure, being attached to frame elements in such a way as to participate in a defined manner in the load-bearing function, and the car-body skin elements having an integral interlayer.

A rail vehicle of this kind is known from EP 0 474 510 A1. The car-body skin elements are filled on the inside with honeycomb metal structures. They allow these sandwich elements to perform a supporting action to meet the static requirements. However, EP 0 474 510 A1 does not give any indication of a simultaneous defined vibration damping construction of such rail vehicles.

A rail vehicle of this kind is known from DE 195 12 629 A1. Its side-wall elements are of rigid (nonvibration-damping) design and are attached to the framework in a nonload-bearing manner by an adhesive joint, the adhesive joint serving to damp vibrations that occur during the operation of the rail vehicle. The adhesive must have a sufficient layer thickness to perform the damping work planned for the absorption of the vibrations. At the same time, it is explained that an excessively thin layer of adhesive would not lead to damping but to rigidity of the structure, which would necessitate other measures to control the troublesome vibrations and would only be achievable with side wall elements that were designed in a corresponding way as load-bearing in terms of their strength.

The object on which the invention is based is to indicate a particularly lightweight rail vehicle with a self-supporting type of car body that not only meets the static requirements but furthermore offers the possibility of constructing the vehicle in such a way that vibrations are damped in a defined manner.

This object is achieved in conjunction with the features of the precharacterizing clause of claim 1 by virtue of the fact that the integral interlayer has defined vibration-damping properties.

The advantages that can be achieved with the invention are, in particular, that the frame elements of the rail vehicle designed in accordance with the invention can be made of lighter and smaller (slimmer) dimensions than in the known case. Since the car-body skin elements themselves are embodied as load-bearing components, they assume part of the supporting function of the framework. Overall, a reduced-weight and therefore economical car body is obtained. Of great importance here are the non-positive fixings between the car-body skin elements and the frame elements, which are embodied as adhesive or screwed or riveted joints. Troublesome vibrations (natural bending vibrations) that occur during the operation of the rail vehicle are damped to a sufficient degree by a correspondingly designed interlayer in the car-body skin elements, which are preferably embodied in the form of sandwich elements. A high degree of ride comfort over the entire frequency range excited is guaranteed.

Advantageous refinements of the invention are characterized in the subclaims.

Further advantages of the rail vehicle proposed will become apparent from the following description.

Figure 2:
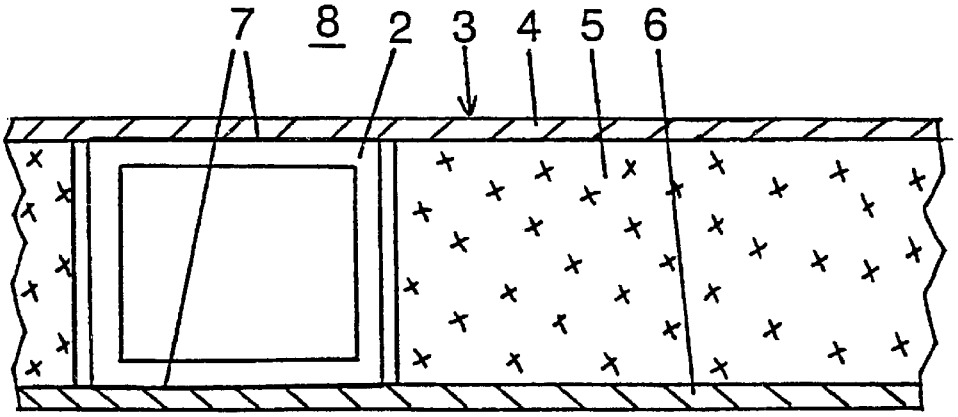
Figure 3:
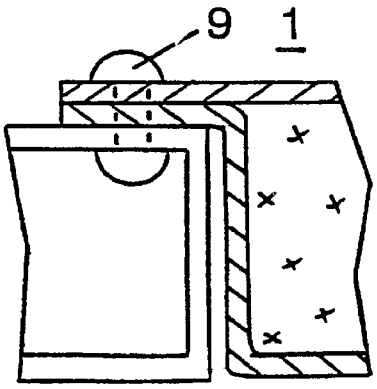
Figure 4:
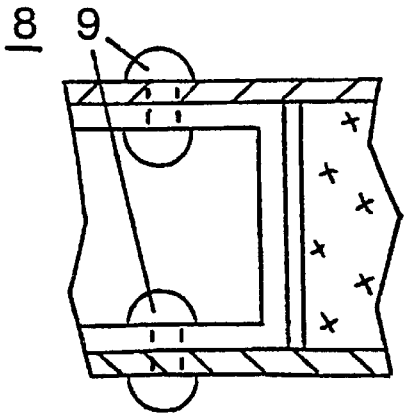

The invention is explained in greater detail below with reference to the exemplary embodiments illustrated in the drawing, in which:

FIG. 1 shows a ribbed plate-type supporting structure in accordance with a first embodiment, FIG. 2 shows a ribbed plate-type supporting structure in accordance with a second embodiment, FIG. 3 shows an alternative non-positive connection for the ribbed plate-type supporting structure in accordance with the first embodiment, and FIG. 4 shows an alternative non-positive connection for the ribbed plate-type supporting structure in accordance with the second embodiment.

FIG. 1 shows a ribbed plate-type supporting structure in accordance with a first embodiment. The ribbed plate-type supporting structure 1 is formed from frame elements 2 (framework elements, elements of a supporting structure) and car-body skin elements designed as load-bearing sandwich elements 3. Car-body skin elements refer, in particular, to the side-wall elements and, where appropriate, roof elements and/or floor elements.

A load-bearing sandwich element 3 comprises an outer layer 4 (top layer, top ply, top panel), a spacing interlayer 5 with heat- and/or sound-insulating and vibration-damping properties, and an inner layer 6 (bottom layer, bottom ply). The outer layer 4 and/or the inner layer 6 can be formed by sheet metal (aluminum), a plastic laminate, a nonwoven or a woven layer, it being advantageously possible to use a woven carbon layer, for example.

Of particular importance are the non-positive adhesive joints 7 between the frame elements 2 and the load-bearing car-body skin elements, i.e. the sandwich elements 3. Suitable single-component or multi-component adhesives can be used here. In the first embodiment in accordance with FIG. 1, each sandwich element 3 is completely surrounded by the outer layer 4 and the inner layer 6, for which purpose the inner layer 6 is bent over at right angles all the way round at the narrow ends of the sandwich element 3, and the outer edges of the outer layer 4 and the inner layer 6 are connected in a non-positive manner to one another in order in this way to form the all-round web of the sandwich element 3 required for adhesive bonding with the outward-facing sides of the frame elements 2.

FIG. 2 shows a ribbed plate-type supporting structure in accordance with a second embodiment. Once again, the ribbed plate-type supporting structure 8 is formed by frame elements 2 and car-body skin elements designed as load-bearing sandwich elements 3. Once again, a load-bearing sandwich element 3 comprises an outer layer 4, a spacing interlayer 5 with heat- and/or sound-insulating and vibration-damping properties, and an inner layer 6. In contrast to the embodiment in accordance with FIG. 1, separate non-positive adhesive joints 7 are provided between the outward-facing sides of the frame elements 2 and the outer layer 4 and between the inward-facing sides of the frame elements 2 and the inner layer 6. The design of the outer layer 4 and the inner layer 6 is as explained with reference to the figure.

FIG. 3 shows an alternative non-positive joint for the ribbed plate-type supporting structure in accordance with the first embodiment. Here, a non-positive screwed or riveted joint 9 is used between the outward-facing sides of the frame elements 2 and the sandwich elements 3 (with all-round web) instead of the adhesive joint 7.

FIG. 4 shows an alternative non-positive joint for the ribbed plate-type supporting structure in accordance with the second embodiment. Here, a non-positive screwed or riveted joint 9 is used between the outward-facing sides of the frame elements 2 and the outer layer 4 and between the inward-facing sides of the frame elements 2 and the inner layer 6 instead of the adhesive joint 7.

A particularly light self-supporting car body is formed if the thickness of the material and/or the distribution of the characteristic values of the material of the load-bearing car-body skin elements are matched to the loading, it being possible to accomplish this when using fiber composite materials, for example, by selective orientation of the fibers of the outer layer 4 and/or inner layer 6. In this embodiment, different car-body skin elements (sandwich elements 3), which, in terms of strength are each designed to be load-bearing, are used in sections of the car body subjected to different forces, these skin elements being matched precisely to the loading that actually occurs and adapted with a view to weight reduction, and preferably the corresponding frame elements 2 are likewise each constructed differently, being optimized as regards weight and matched to the loading.

LIST OF REFERENCE NUMERALS

1 Ribbed plate-type supporting structure
2 Frame element
3 Load-bearing sandwich element
4 Outer layer
5 Interlayer
6 Inner layer
7 Non-positive adhesive joint
8 Ribbed plate-type supporting structure
9 Non-positive screwed or riveted joint

What is claimed is:

1. A rail vehicle with a self-supporting car body with a floor and a roof and with side walls, which have windows and entry zones, the structural car-body elements situated above the floor being formed by a frame that is connected in a rigid manner to the floor and has side-wall and roof elements mounted on it, characterized in that the car-body skin elements are of load-bearing design and are attached to frame elements in such a way as to participate in a defined manner in the load-bearing function, and in that the car-body skin elements have an integral vibration damping interlayer.

2. The rail vehicle as claimed in claim 1, characterized by force transmitting adhesive joints between frame elements and the load-bearing car-body skin elements.

3. The rail vehicle as claimed in claim 1, characterized by force transmitting screwed or riveted joints between frame elements and the load-bearing car-body skin elements.

4. The rail vehicle as claimed in claim 1, characterized by design of the load-bearing car-body skin elements as load-bearing sandwich elements, formed by an outer layer, a spacing interlayer with mechanical and/or heat- and/or sound-insulating and vibration-damping properties, and an inner layer.

5. The rail vehicle as claimed in claim 4, characterized in that the outer layer and/or the inner layer are formed by sheet metal.

6. The rail vehicle as claimed in claim 4, characterized in that the outer layer and/or the inner layer are formed by fiber composite material.

7. The rail vehicle as claimed in claim 4, characterized in that the outer layer and/or the inner layer are formed by a plastic laminate.

8. The rail vehicle as claimed in claim 4, characterized in that the outer layer and/or the inner layer are formed by a nonwoven fiber layer.

9. The rail vehicle as claimed in claim 4, characterized in that the outer layer and/or the inner layer are formed by a woven layer.

10. The rail vehicle as claimed in claim 9, characterized in that the woven layer is a woven carbon layer.

11. The rail vehicle as claimed in claim 1, characterized in that the thickness of the material and/or the distribution of the characteristic values of the material of the load-bearing car-body skin elements are matched to the intended loading.

12. The rail vehicle as claimed in claim 2, characterized by design of the load-bearing car-body skin elements as load-bearing sandwich elements, formed by an outer layer, a spacing interlayer with mechanical and/or heat- and/or sound-insulating and vibration-damping properties, and an inner layer.

13. The rail vehicle as claimed in claim 3, characterized by design of the load-bearing car-body skin elements as load-bearing sandwich elements, formed by an outer layer, a spacing interlayer with mechanical and/or heat- and/or sound-insulating and vibration-damping properties, and an inner layer.

14. The rail vehicle as claimed in claim 5, characterized in that the outer layer and/or the inner layer are formed by a plastic laminate.

15. The rail vehicle as claimed in claim 6, characterized in that the outer layer and/or the inner layer are formed by a plastic laminate.

16. The rail vehicle as claimed in claim 5, characterized in that the outer layer and/or the inner layer are formed by a nonwoven fiber layer.

17. The rail vehicle as claimed in claim 6, characterized in that the outer layer and/or the inner layer are formed by a nonwoven fiber layer.

18. The rail vehicle as claimed in claim 7, characterized in that the outer layer and/or the inner layer are formed by a nonwoven fiber layer.

19. The rail vehicle as claimed in claim 5, characterized in that the outer layer and/or the inner layer are formed by a woven layer.

20. The rail vehicle as claimed in claim 6, characterized in that the outer layer and/or the inner layer are formed by a woven layer.

21. The rail vehicle as claimed in claim 7, characterized in that the outer layer and/or the inner layer are formed by a woven layer.

22. The rail vehicle as claimed in claim 8, characterized in that the outer layer and/or the inner layer are formed by a woven layer.

23. The rail vehicle as claimed in claim 2, characterized in that the thickness of the material and/or the distribution of the characteristic values of the material of the load-bearing car-body skin elements are matched to the intended loading.

24. The rail vehicle as claimed in claim 3, characterized in that the thickness of the material and/or the distribution of the characteristic values of the material of the load-bearing car-body skin elements are matched to the intended loading.

25. The rail vehicle as claimed in claim 4, characterized in that the thickness of the material and/or the distribution of the characteristic values of the material of the load-bearing car-body skin elements are matched to the intended loading.

26. The rail vehicle as claimed in claim 5, characterized in that the thickness of the material and/or the distribution of the characteristic values of the material of the load-bearing car-body skin elements are matched to the intended loading.

27. The rail vehicle as claimed in claim 6, characterized in that the thickness of the material and/or the distribution of the characteristic values of the material of the load-bearing car-body skin elements are matched to the intended loading.

28. The rail vehicle as claimed in claim 7, characterized in that the thickness of the material and/or the distribution of the characteristic values of the material of the load-bearing car-body skin clients are matched to the intended loading.

29. The rail vehicle as claimed in claim 8, characterized in that the thickness of the material and/or the distribution of the characteristic values of the material of the load-bearing car-body skin elements are matched to the intended loading.

30. The rail vehicle as claimed in claim 9, characterized in that the thickness of the material and/or the distribution of the characteristic values of the material of the load-bearing car-body skin elements are matched to the intended loading.

31. The rail vehicle as claimed in claim 10, characterized in that the thickness of the material and/or the distribution of the characteristic values of the material of the load-bearing car-body skin elements are matched to the intended loading.

* * * * *

UNITED STATES PATENT AND TRADEMARK OFFICE

CERTIFICATE OF CORRECTION

PATENT NO. : 6,647,897 B1
DATED : November 18, 2003
INVENTOR(S) : Klamka et al.

It is certified that error appears in the above-identified patent and that said Letters Patent is hereby corrected as shown below:

Column 1,
Line 3, insert the heading -- Background of the Invention --, followed by the heading "1. Field of the Invention";
Line 8, delete the word "flexurally";
Line 15, insert the heading -- 2. Description of the Related Art --;
Line 22, insert the word -- also -- between "is" and "known";
Line 36, insert the heading -- Brief Summary of the Invention --;
Line 43, delete the wording "the precharacterizing clause of";
Line 54, replace the word "non-positive" by -- force transmitting --;
Line 62, insert the word -- excited -- between "entire" and "frequency";
Line 63, delete the word "excited";

Column 2,
Line 1, insert the heading -- Brief Description of the Drawings --;
Lines 8, 11, 30, 40, 53, 59, 61, 65 and 67, replace the word "non-positive" by -- force transmitting --;
Line 14, insert the heading -- Description of Illustrative Embodiments --;

Column 3,
Lines 27 and 29, replace the word "non-positive" by -- force transmitting --.

Signed and Sealed this

Twentieth Day of April, 2004

JON W. DUDAS
*Acting Director of the United States Patent and Trademark Office*